US010190374B2

(12) United States Patent
Bowley et al.

(10) Patent No.: US 10,190,374 B2
(45) Date of Patent: Jan. 29, 2019

(54) VERTICAL PIPE HANDLING SYSTEM AND METHOD

(71) Applicant: Nabors Drilling Technologies USA, Inc., Houston, TX (US)

(72) Inventors: Ryan Thomas Bowley, Calgary (CA); Brent James William Coombe, Calgary (CA)

(73) Assignee: Nabors Drilling Technologies USA, Inc., Houston, TX (US)

( * ) Notice: Subject to any disclaimer, the term of this patent is extended or adjusted under 35 U.S.C. 154(b) by 463 days.

(21) Appl. No.: 14/600,933

(22) Filed: Jan. 20, 2015

(65) Prior Publication Data

US 2016/0208566 A1 Jul. 21, 2016

(51) Int. Cl.
*E21B 19/15* (2006.01)
*E21B 19/20* (2006.01)

(52) U.S. Cl.
CPC ..... *E21B 19/155* (2013.01); *E21B 19/20* (2013.01)

(58) Field of Classification Search
CPC ..... E21B 19/155; E21B 19/20; E21B 19/14; E21B 19/15
See application file for complete search history.

(56) References Cited

U.S. PATENT DOCUMENTS

2006/0104747 A1* 5/2006 Zahn ..... E21B 19/14 414/22.63
2013/0302114 A1* 11/2013 Reddy ..... E21B 3/02 414/22.55
2014/0133939 A1* 5/2014 Richardson ..... E21B 19/14 414/22.55

* cited by examiner

*Primary Examiner* — David J Bagnell
*Assistant Examiner* — Brandon M Duck
(74) *Attorney, Agent, or Firm* — Enrique Abarca; Abel Law Group, LLP

(57) ABSTRACT

A system includes a cage having a pipe rack configured to store a tubular in a vertical orientation, such that a longitudinal axis of the tubular is substantially perpendicular to a horizontal plane. The system also includes a first robotic pipe handler configured to transition the tubular from a horizontal orientation, in which the longitudinal axis of the tubular is substantially parallel to the horizontal plane, to the vertical orientation. The first robotic pipe handler transitions between a raised position and a lowered position about a first handler axis.

17 Claims, 12 Drawing Sheets

VERTICAL PIPE HANDLING SYSTEM AND METHOD

BACKGROUND

Embodiments of the present disclosure relate generally to the field of drilling and processing of wells. More particularly, present embodiments relate to a system and method for storing and positioning drill pipe during drilling operations.

Top drives are typically utilized in well drilling and maintenance operations, such as operations related to oil and gas exploration. In conventional oil and gas operations, a well is typically drilled to a desired depth with a drill string, which includes drill pipe and a drilling bottom hole assembly (BHA). During a drilling process, the drill string may be supported and hoisted about a drilling rig by a hoisting system for eventual positioning down hole in a well. As the drill string is lowered into the well, a top drive system may rotate the drill string to facilitate drilling.

BRIEF DESCRIPTION

In accordance with one aspect of the disclosure, a system includes a cage having a pipe rack configured to store a tubular in a vertical orientation, such that a longitudinal axis of the tubular is substantially perpendicular to a horizontal plane. The system also includes a first robotic pipe handler configured to transition the tubular from a horizontal orientation, in which the longitudinal axis of the tubular is substantially parallel to the horizontal plane, to the vertical orientation. The first robotic pipe handler transitions between a raised position and a lowered position about a first handler axis.

In accordance with another aspect of the disclosure, a method includes sending a first signal to a first robotic pipe handler, via a controller, to engage a tubular positioned in a horizontal orientation, in which a longitudinal axis of the tubular is substantially parallel to a horizontal plane. The method also includes transitioning the first robotic pipe handler from a raised position to a lowered position, such that the first robotic pipe handler engages the tubular via a first clamp. The method further includes sending a second signal to the first robotic pipe handler, via the controller, to transition the tubular to a vertical orientation within a cage, in which the longitudinal axis is substantially perpendicular to the horizontal plane, via rotation about a first handler axis. The method also includes sending a third signal, via the controller, to a second robotic pipe rack to engage the tubular and to position the tubular within a vertical pipe rack.

In accordance with another aspect of the disclosure, a system includes a controller configured to coordinate operation of a pipe handling system and a top drive system of a drilling rig to position a tubular in a centered position proximate to the top drive system and to enable the top drive system to engage the tubular. The system also includes a first robotic pipe handler of the pipe handling system communicatively coupled to the controller and configured to transfer the tubular from a horizontal orientation to a vertical orientation. Additionally, the system includes a second robotic pipe handler of the pipe handling system communicatively coupled to the controller and configured to transfer the tubular from the first robotic pipe handler to a vertical pipe rack. The first and second robotic pipe handlers are positioned adjacent to the drilling rig.

DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

Present embodiments provide a pipe handling system configured to store and position sections of drill pipe during drilling operations. For example, the pipe handling system may transition a section of drill pipe in a horizontal orientation to a vertical orientation via a first robotic pipe handler. The pipe handling system may be configured to store the drill pipe in a storage rack in the vertical orientation in preparation for use during drilling operations. Furthermore, a second robotic pipe handler may transition the drill pipe from the vertical orientation to a centered position that centers the drill pipe over a wellbore and into mechanical engagement with a top drive system. For example, the second robotic pipe handler may be programmed to remove the drill pipe from the storage rack, transition the pipe over a drill floor, and center the drill pipe over the wellbore.

Figure 1:
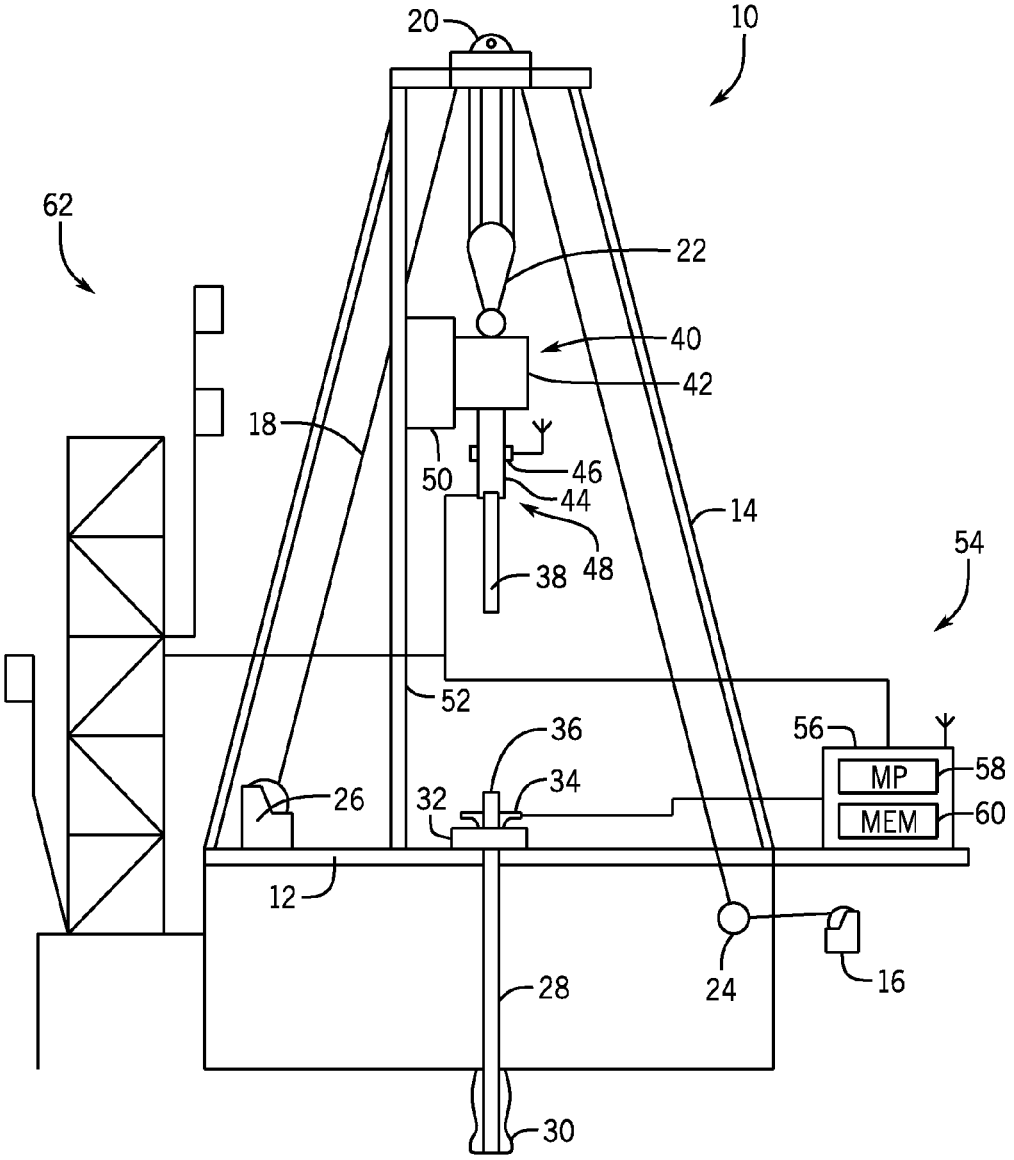
FIG. 1 is a schematic of an embodiment of a well being drilled with a pipe handling system, in accordance with present techniques.

Turning now to the drawings, FIG. 1 is a schematic view of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34 (e.g., power slips). A portion of the drill string 28 extends above the rig floor 12, forming a stump 36 to which another length of tubular 38 (e.g., a joint of drill pipe) may be added.

A tubular drive system 40, hoisted by the traveling block 22, positions the tubular 38 above the wellbore 30. In the illustrated embodiment, the tubular drive system 40 includes a top drive 42, a gripping device 44, and a tubular drive monitoring system 46 (e.g., an operating parameter monitoring system) configured to measure forces acting on the tubular drive system 40, such as torque, weight, and so forth. For example, the tubular drive monitoring system 46 may measure forces acting on the tubular drive system 40 via sensors, such as strain gauges, gyroscopes, pressure sensors, accelerometers, magnetic sensors, optical sensors, or other sensors, which may be communicatively linked or physically integrated with the system 46. The gripping device 44 of the tubular drive system 40 is engaged with a distal end 48 (e.g., box end) of the tubular 38. The tubular drive system 40, once coupled with the tubular 38, may then lower the coupled tubular 38 toward the stump 36 and rotate the tubular 38 such that it connects with the stump 36 and becomes part of the drill string 28. FIG. 1 further illustrates the tubular drive system 40 coupled to a torque bushing system 50. More specifically, the torque bushing system 50 couples the tubular drive system 40 to a torque track 52. The torque bushing system 50 and the torque track 52 function to counterbalance (e.g., counter react) moments (e.g., overturning and/or rotating moments) acting on the tubular drive system 40 and further stabilize the tubular drive system 40 during a casing running operation or other operation.

The drilling rig 10 further includes a control system 54, which is configured to control the various systems and components of the drilling rig 10 that grip, lift, release, and support the tubular 38 and the drill string 28 during a casing running or tripping operation. For example, the control system 54 may control operation of the gripping device 44 and the power slips 34 based on measured feedback (e.g., from the tubular drive monitoring system 46 and other sensors) to ensure that the tubular 30 and the drill string 28 are adequately gripped and supported by the gripping device 44 and/or the power slips 34 during a casing running operation. In this manner, the control system 54 may reduce and/or eliminate incidents where lengths of tubular 38 and/or the drill string 28 are unsupported. Moreover, the control system 54 may control auxiliary equipment such as mud pumps, robotic pipe handlers, and the like.

In the illustrated embodiment, the control system 54 includes a controller 56 having one or more microprocessors 58 and a memory 60. For example, the controller 56 may be an automation controller, which may include a programmable logic controller (PLC). The memory 60 is a non-transitory (not merely a signal), computer-readable media, which may include executable instructions that may be executed by the microprocessor 56. The controller 56 receives feedback from the tubular drive monitoring system 46 and/or other sensors that detect measured feedback associated with operation of the drilling rig 10. For example, the controller 56 may receive feedback from the tubular drive system 46 and/or other sensors via wired or wireless transmission. Based on the measured feedback, the controller 56 regulates operation of the tubular drive system 46 (e.g., increasing rotation speed).

In the illustrated embodiment, the drilling rig 10 also includes a pipe handling system 62. The pipe handling system 62 is configured to store tubulars 38 (e.g., single stands, double stands, triple stands) in a vertical orientation proximate to the derrick 14. As will be described in detail below, in certain embodiments, the pipe handling system 62 is positioned proximate to the rig floor 12 and supported by a sub. However, in other embodiments, the pipe handling system 62 may be disposed on the rig floor 12, on the ground, or the like.

It should be noted that the illustration of FIG. 1 is intentionally simplified to focus on the pipe handling system 62 of the drilling rig 10, which is described in greater detail below. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform.

Figure 2:
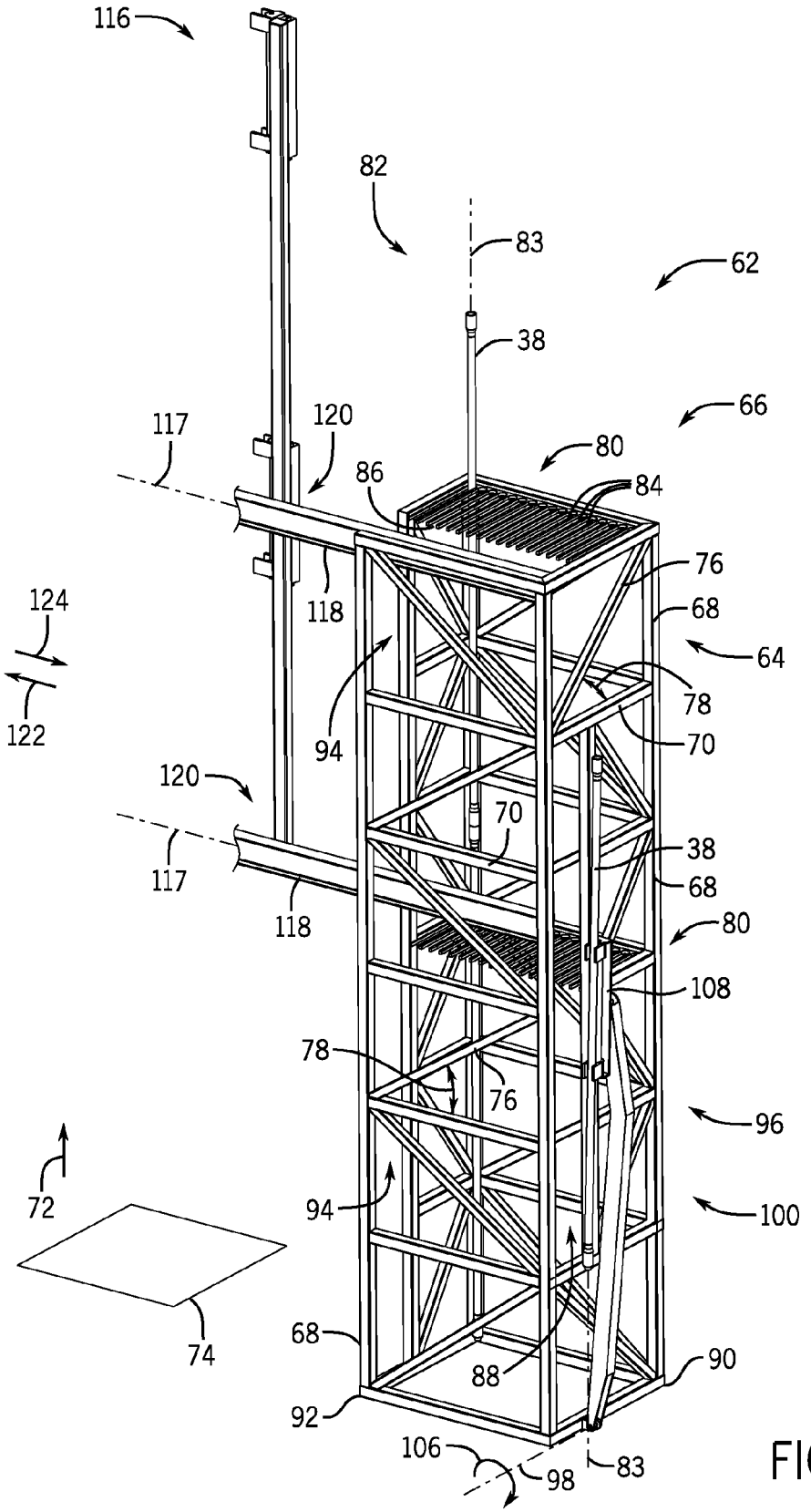
FIG. 2 is a perspective view of an embodiment of a pipe handling system, in accordance with present techniques.

FIG. 2 is a perspective view of an embodiment of the pipe handling system 62. The pipe handling system 62 includes support members 64 configured to form a semi-rigid and structurally secure cage 66. That is, the support members 64 enable the cage 66 to support the weight of the tubular 38 and robotic pipe handlers. In certain embodiments, the cage 66 is not attached to the derrick 14. However, in other embodiments, the cage 66 may be coupled to the derrick 14, rig floor 12, or other parts of the drilling rig 10. For example, in certain embodiments, the cage 66 is coupled to the rig floor 12. The cage includes vertical support members 68 aligned with horizontal support members 70 at approximately 90 degree angles. In other words, the vertical support members 68 and the horizontal support members 70 are substantially perpendicular to one another. Furthermore, the vertical support members 68 are substantially parallel to a vertical axis 72. Moreover, the vertical axis 72 is substantially perpendicular to a horizontal plane 74 (e.g., the ground, the rig floor 12, a platform). As a result, the horizontal support members 70 are substantially parallel to the horizontal plane 74. As shown, the horizontal support members 70 are configured to couple adjacent vertical support members 68 together, forming a generally rectangular cage 66. While the cage 66 shown in FIG. 2 is generally rectangular, the cage 66 may be different configurations in other embodiments. In the illustrated embodiment, the cage 66 includes angled support members 76 arranged between adjacent horizontal support members 70 along the cage 66. As shown, the angled support members 76 are coupled to the vertical support members 68 and horizontal support members 70 at an angle 78 substantially equal to 45 degrees relative to the horizontal plane 74 (e.g., 45 degrees plus or minus 15 degrees). However, the angle 78 may be particularly selected based on the configuration of the cage 66. It should be noted that the use of geometric terms such as "parallel", "perpendicular", and specific angles is intended to convey a practical positional relationship and should not be interpreted as requiring a rigid mathematical relationship that would essentially be impossible to achieve in reality.

As described above, the cage 66 is a semi-rigid structure configured to support the tubulars 38 and other auxiliary equipment (e.g., the robotic pipe handlers). As a result, the cage 66 may be configured to be self-supporting or not coupled to the drilling rig 10. Accordingly, in certain embodiments, the cage 66 may be assembled and transported to a work site. As a result, the cage 66 dimensions may be particularly selected based on the drilling rig 10 and/or work site. Moreover, because of the support provided by the support members 64, the cage 66 is configured to travel to work sites pre-built for particular applications. For example, the cage 66 may arrive on a flatbed truck and be placed proximate to the drilling rig 10 via a crane coupled to a lifting lug. However, in other embodiments, the cage 66 may be constructed at the work site to accommodate the specifications of the drilling rig 10. As will be described below, the modularity of the cage 66 and the pipe handling system 62 may enable operators to stack tubulars 38 in a vertical pipe rack while other drilling operations are being prepared.

In the illustrated embodiment, the cage 66 includes pipe racks 80 coupled to the horizontal support members 70. While the illustrated embodiment includes two pipe racks 80, in other embodiments, there may be 1, 3, 4, 5, 6, or any suitable number of pipe racks 80 to support the tubulars 38 in a vertical orientation 82. As used herein, the vertical orientation 82 refers to an orientation where a longitudinal axis 83 of the tubulars 38 is substantially parallel to the vertical axis 72. Moreover, the pipe racks 80 include fingers 84 extending laterally from the horizontal support members 70. The fingers 84 are substantially parallel to the horizontal plane 74 and are separated by a rack space 86 configured to enable the tubular 38 to be placed between adjacent fingers 84. In certain embodiments, the pipe racks 80 are modular and may be modified at the work site to accommodate tubulars 38 of varying diameters. For instance, a portion of the pipe rack 80 may be configured to receive and support tubulars 38 with an outer diameter of 5 inches while another portion of the pipe rack 80 is configured to receive and support tubulars 38 with an outer diameter of 3 inches. In certain embodiments, the fingers 84 may include a coating (e.g., polymer, metallic) to reduce surface marring and/or scratching of the tubulars 38. In the illustrated embodiment, the pipe racks 80 are substantially aligned with one another. As a result, double stands (e.g., two sections of drill pipe coupled together) may be stored and supported by the pipe handling system 62. For example, a lower pipe rack 80 may receive a lower end of the tubular 38 while an upper pipe rack 80 may receive the an upper end of the tubular 38.

In the illustrated embodiment, the cage 66 includes a first passage 88 on a first end 90. The first end 90 is closer to a horizontal pipe rack (not shown) than a second end 92 disposed adjacent to the drilling rig 10. A size of the first passage 88 is particularly selected to accommodate tubulars 38 being transferred into the cage 88 from the horizontal pipe rack. In the illustrated embodiment, the passage 88 extends approximately two-thirds of a height of the cage 66. However, in other embodiments, the first passage 88 may extend one-third of the height of the cage 66, the entire height of the cage 66, or any suitable distance to enable transfer of tubulars 38 from the horizontal pipe rack to the cage 66. Moreover, a second passage 94 is included on the second end 92. In the illustrated embodiment, the second passage 94 extends the entire height of the cage 66. However, as mentioned above, in other embodiments the size of the second passage 94 may be particularly selected to accommodate tubulars 38 of varying size. As will be described below, the second passage 94 is configured to enable passage of the tubulars 38 from the pipe racks 80 to the wellbore 30.

Figure 5:
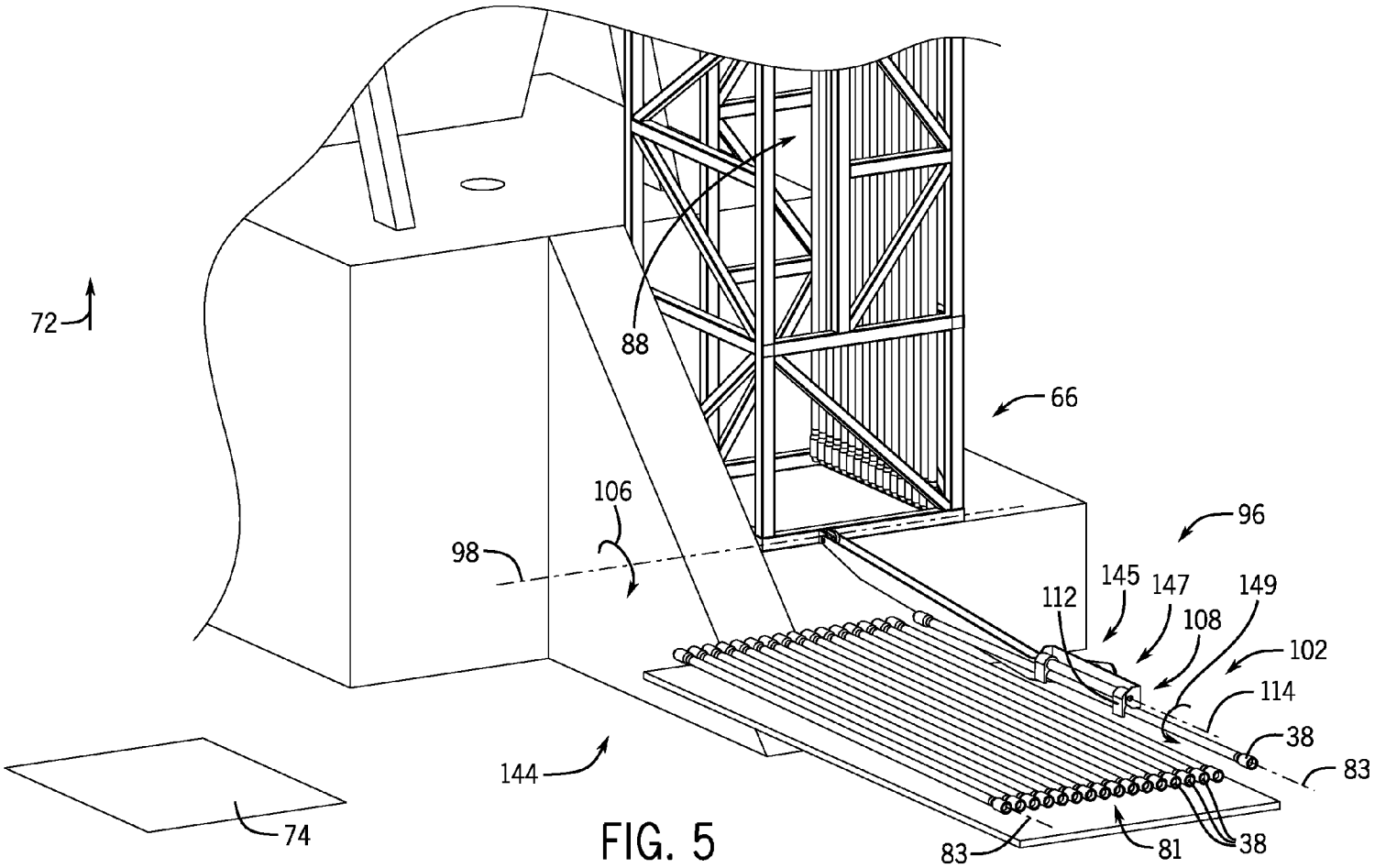
FIG. 5 is a perspective view of the first robotic pipe handler of FIG. 3 in a lowered position, in accordance with present techniques.

As shown in FIG. 2, a first robotic pipe handler 96 is disposed on the first end 90 of the cage 66. The first robotic pipe handler 96 is configured to pivot about a first handler axis 98 between a raised position 100 and a lowered position 102 (FIG. 5). For example, a hydraulic actuator may be coupled to the first robotic pipe handler 96 to drive rotation about the first handler axis 98. However, in other embodiments, an electric actuator, mechanical actuator, or the like may be used to drive rotation of the first robotic pipe handler 96 about the first handler axis 98. As will be described below, the first robotic pipe handler 96 is configured to rotate about the first handler axis 98 in a first direction 106 to transition to the lowered position 102 and engage the tubular 38 with a first clamp 108.

In the illustrated embodiment, the pipe handling system 62 includes a second robotic pipe handler 116 disposed on a pair of tracks 118 (e.g., rails). The tracks 118 are substantially horizontal (e.g., parallel to the horizontal plane 74) and are configured to couple to the cage 66. As shown, the tracks 118 are coupled (e.g., welded, secured with fasteners) to the vertical support members 68 of the cage 66. Moreover, the tracks 118 extend laterally out from the cage 66 and over the rig floor 12. As a result, the cage 66 may be mounted proximate to the rig floor 12, while still enabling the second robotic pipe handler 116 to position the tubulars 38 in a centered position over the wellbore 30. As used herein, centered is intended to convey a positional relationship of the tubular 38 relative to the wellbore 30 and not be interpreted as requiring a rigid alignment of an axis of the tubular 38 with an axis of the wellbore 30. For example, the centered position may refer to the tubular 38 that is positioned within two pipe diameters of the wellbore 30. Therefore, centered refers to the tubular 38 substantially aligned with the wellbore 30. The pipe handling system 62 includes first actuators 120 configured to drive movement of the second robotic pipe handler 116 along a track axis 117 of the tracks 118. The track axis 117 is parallel to the horizontal plane 74. For example, in certain embodiments, the first actuator 120 is an electric motor configured to drive motion of the second pipe hander 116 in a rig direction 122 and a stand direction 124. As a result, the first actuator 120 enables the second robotic pipe handler 116 to receive tubulars 38 from the first pipe handler 96 (e.g., via motion in the stand direction 124 toward the first pipe handler 96) and to position tubulars 38 over the wellbore 30 (e.g., via motion in the rig direction toward the drill rig 10) in the centered position. However, in other embodiments, the tracks 118 may be telescoping beams that are driven toward the wellbore 30 by the first actuators 120.

Figure 3:
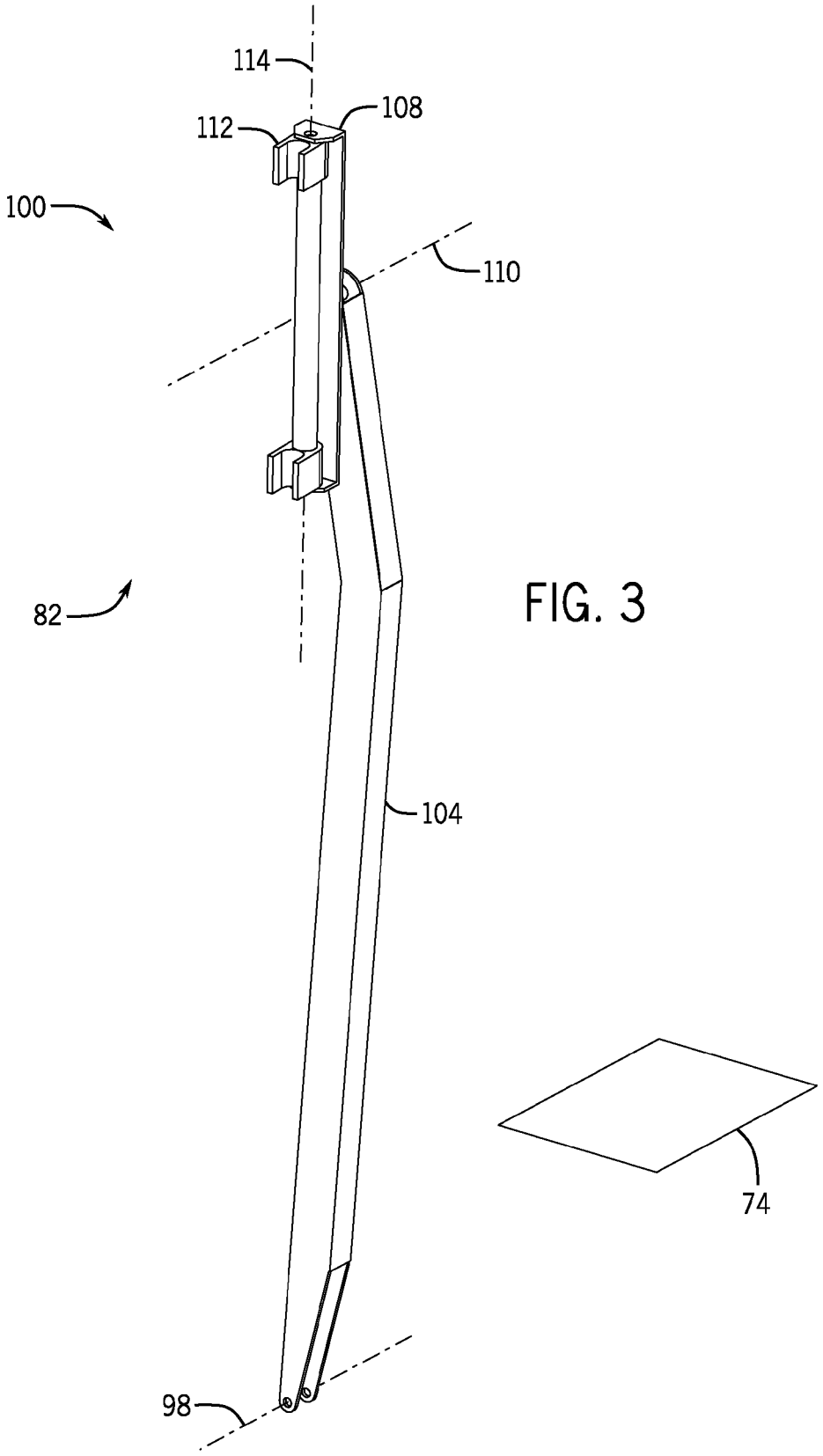
FIG. 3 is a perspective view of a first robotic pipe handler, in accordance with present techniques.

FIG. 3 is a perspective view of the first robotic pipe handler 96 in the raised position 100. In the illustrated embodiment, an arm 104 is substantially perpendicular to the horizontal plane 74 (e.g., in the vertical orientation 82). The first clamp 108 is configured to couple to the arm 104 and to rotate about a clamp axis 110 substantially perpendicular to the arm 104. For example, the first clamp 108 may rotate about the clamp axis 110 to align a clamp jaw 112 with the tubular 38. As mentioned above, a hydraulic actuator, electric actuator, or the like may be coupled to the first clamp 108 to drive rotation about the clamp axis 110. The clamp jaw 112 is configured to engage the tubular 38 and secure the tubular 38 to the first clamp 108. For example, as shown in FIG. 2, the clamp jaw 112 may hold a tubular 38 in the vertical orientation 82 before transferring the tubular 38 into the cage 66 for storage in the pipe rack 80. Moreover, the clamp jaw 112 is configured to rotate about a jaw axis 114. The jaw axis 114 is substantially parallel to the first clamp 108 in the illustrated embodiment. As will be described in detail below, rotation of the clamp jaw 112 about the jaw axis 114 enables the first clamp 108 to lift the tubular 38 from the horizontal pipe rack and transfer the tubular 38 to a second robotic pipe handler.

Figure 4:
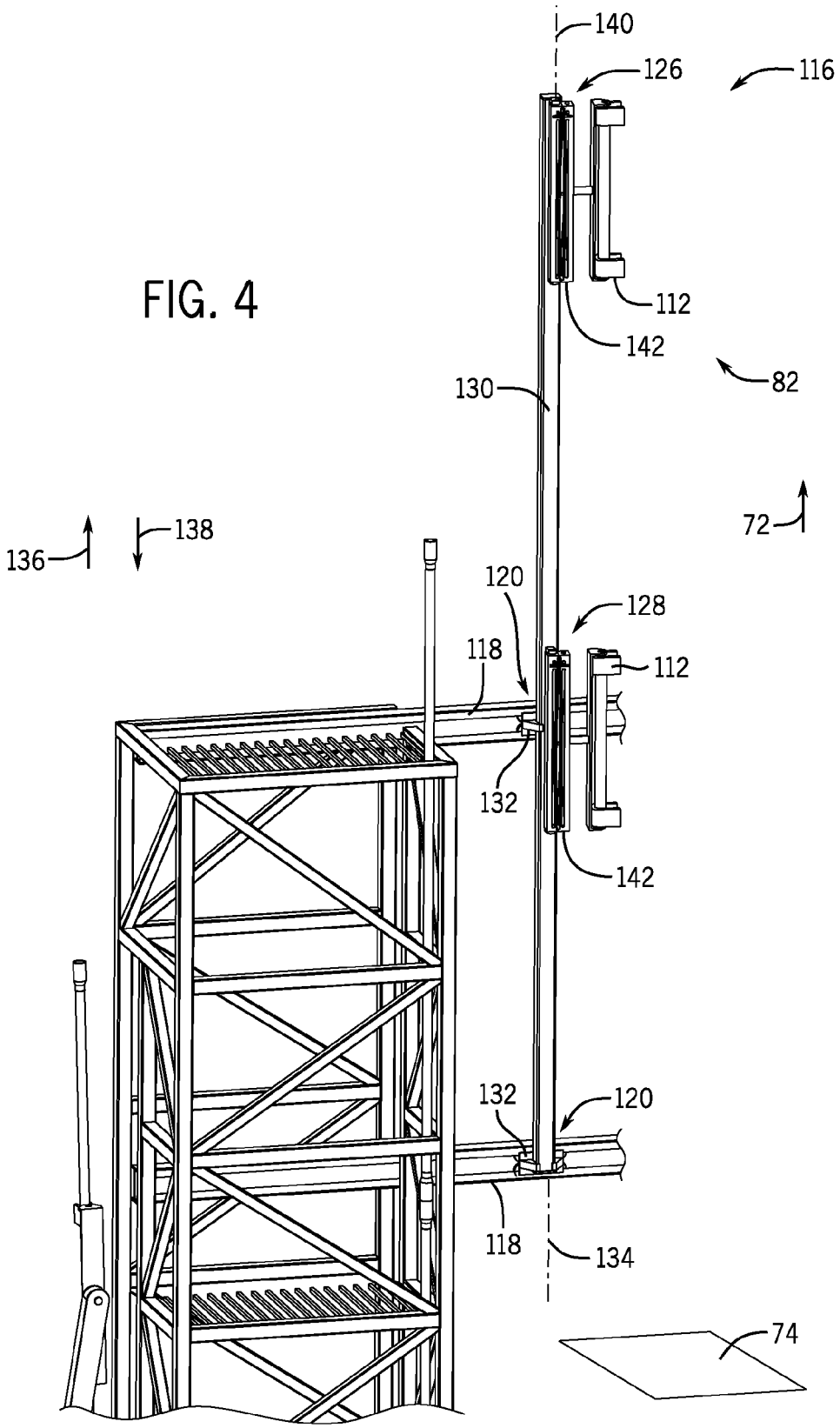
FIG. 4 is a perspective view of a second robotic pipe handler coupled to a cage, in accordance with present techniques.

FIG. 4 is a perspective view of the second pipe handler 116 positioned on the tracks 118. The second pipe handler 116 includes a second clamp 126 and a third clamp 128 disposed on a body 130. As shown, the third clamp 128 is vertically displaced from the second clamp 126. As will be appreciated, separating the clamps 126, 128 enables the second robotic pipe handler 116 to grasp long tubulars 38 (e.g., two tubulars 38 coupled together) at multiple points along the length of the tubular 38, thereby providing resistance to motion (e.g., swaying). The body 130 is arranged in the vertical orientation 82 and is configured to couple to the tracks 118 via brackets 132. The brackets 132 are configured to secure the body 130 to the tracks 118 and to enable movement of the body 130 along a body axis 134. For example, in the illustrated embodiment, the brackets 132 include electric actuators configured to drive the body 130 along the body axis 134 in an upward direction 136 and a downward direction 138. For instance, the body 130 may be moved in the downward direction 138 to align both the second and third clamps 126, 128 with a double stand (e.g., two tubulars 38 coupled together) in order to support the double stand at two points while moving the double stand toward the wellbore 30. While the illustrated embodiment includes an electric actuator, in other embodiments the brackets 132 may include hydraulic actuators, rollers, or a mechanical pulley system to enable movement of the body 130 in the upward direction 136 and the downward direction 138.

As mentioned above, the second pipe handler 116 includes the second clamp 126 and the third clamp 128 including clamp jaws 112. The clamp jaws 112 are configured to secure the tubulars 38 to the first and second clamps 126, 128. For instance, the clamp jaws 112 may be hydraulically actuated and configured to apply a force to the outer diameter of the tubulars 38. However, in other embodiments, the clamp jaws 112 may be electrically or mechanically actuated. As shown, the second and third clamps 126, 128 are arranged along the body 130 and are configured to rotate about a second clamp axis 140. The second clamp axis 140 is substantially perpendicular to the body axis 134. As will be described in detail below, rotation about the second clamp axis 140 enables the second and third clamps 126, 128 to transition the tubulars 38 between the pipe racks 80 and the wellbore 30. In certain embodiments, the second and third clamps 126, 128 are configured to independently rotate about the second clamp axis 140. However, in other embodiments, rotation of the second clamp 126 may drive rotation of the third clamp 128, and vice versa.

In the illustrated embodiment, the second and third clamps 126, 128 include second actuators 142. The second actuators 142 are configured to move the clamp jaws 112 of the second and third clamps 126, 128 laterally away from the body 130. In other words, the second actuators 142 enable the clamp jaws 112 of the second and third clamps 126, 128 to extend away from the body 130 along the horizontal plane 74. In certain embodiments, the second actuators 142 are configured to independently move the clamp jaws 112 of the second and third clamps 126, 128 away from the body 130. As will be discussed in detail below, the second actuators 142 enable the pipe handling system 62 to be positioned proximate to the rig floor 12, while still maintaining clearance around the wellbore 30. While the illustrated embodiment includes scissor-type actuators, in certain embodiments different actuators may be utilized to move the clamp jaws 112 of the second and third clamps 126, 128 away from the body 130. For instance, a linear actuator or hydraulic cylinder may be used to laterally displace the clamp jaws 112 from proximate to the body 130 to a centered position over the wellbore 30.

FIGS. 5-11 are perspective views of an embodiment of the pipe handling system 62, illustrating operation of the first and second robotic pipe handlers 96, 116 transitioning the tubular 38 from a horizontal pipe rack 144 to a centered position over the wellbore 30. However, it will be appreciated that, in certain embodiments, the pipe handling system 62 may be configured to position each of the tubulars 38 in the pipe racks 80 before centering the tubulars 38 over the wellbore 30.

In FIG. 5, the first robotic pipe handler 96 is in the lowered position 102 via rotation in the first direction 106 about the first handler axis 98. Tubulars 38 are arranged on a horizontal pipe rack 144 proximate to the cage 66 in a horizontal orientation 81. While the illustrated embodiment includes single stand tubulars 38, in other embodiments double stand tubulars 38 may be arranged on the horizontal pipe rack 144. As shown, the longitudinal axes 83 of the tubulars 38 are substantially perpendicular to the vertical axis 72 and substantially parallel to the horizontal plane 74. Moreover, the first clamp 108 is engaged with the tubular 38 while oriented in an engagement position 145. While in the engagement position 145, the clamp jaws 112 are oriented such that a back end 147 of the clamp jaw 112 is facing the cage 66. In other words, the clamp jaw 112 rotates about the jaw axis 114 in an engagement direction 149 to position the clamp jaw in the engagement position 145. As a result, the clamp jaw 112 is configured to receive the tubular 38 from the horizontal pipe rack 144. That is, the first clamp 108 is aligned with the tubular 38 and the clamp jaw 112 secures the tubular 38 to the first clamp 108. In certain embodiments, the tubulars 38 may be arranged on the horizontal pipe rack 144 at a predetermined distance to facilitate alignment with the first robotic pipe handler 96. For example, in the illustrated embodiment, the first robotic pipe handler 96 is positioned to grip the tubular 38 at approximately the center of the tubular 38. However, in other embodiments, the first clamp 108 may grip the tubular 38 in other positions (e.g., one-third of the length of the tubular 38) to facilitate transitioning the tubular 38 from the horizontal pipe rack 144 to the cage 66 through the first passage 88.

The first robotic pipe handler 96 is configured to transition tubulars 38 from the horizontal pipe rack 144 to the vertical orientation 82 during drilling operations, before drilling operations, and after drilling operations. For example, the first robotic pipe handler 96 may arrange the tubulars 38 in the pipe racks 80 while workers prepare the drilling rig 10 for drilling operations. Furthermore, in certain embodiments, the first robotic pipe handler 96 is configured to transition tubulars 38 from the pipe racks 80 to the horizontal pipe rack 144. For example, while the drill rig 10 is being torn down, the first robotic pipe handler 96 may arrange the tubulars 38 on the horizontal pipe rack 144.

Figure 6:
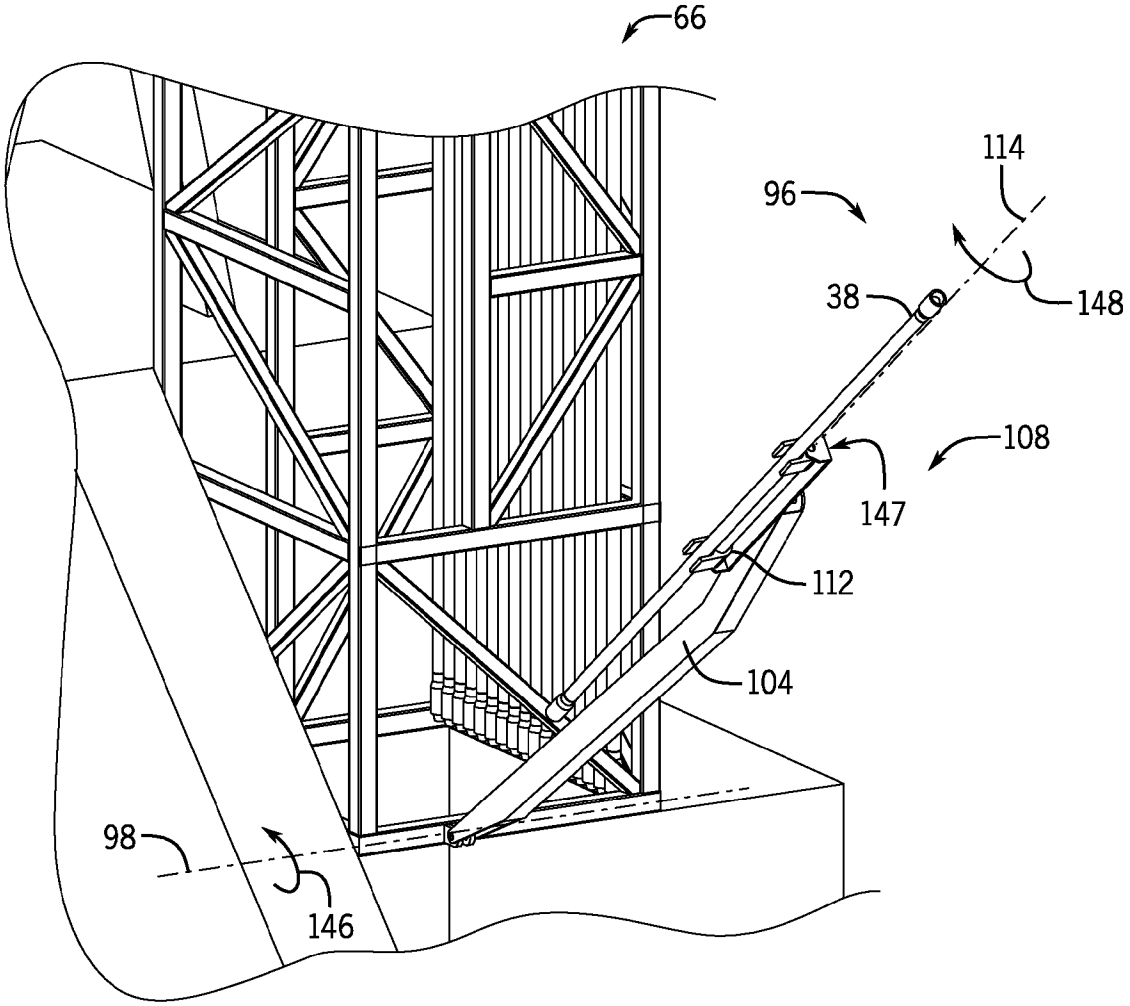
FIG. 6 is a perspective view of the first robotic pipe handler of FIG. 3 transitioning toward a raised position, in accordance with present techniques.
Figure 7:
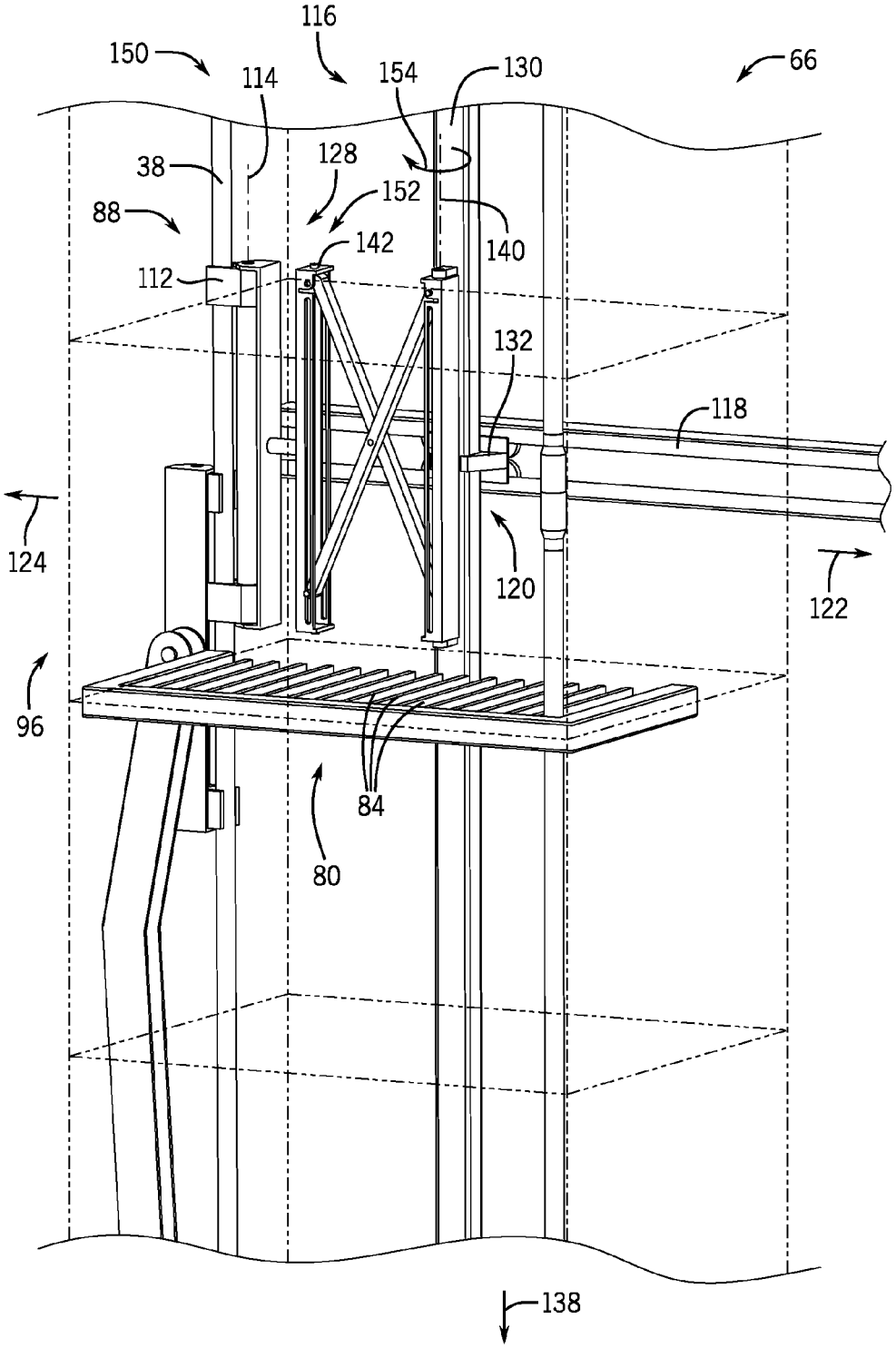
FIG. 7 is a perspective view of the second robotic pipe handler of FIG. 4 coupling to a tubular, in accordance with present techniques.

As shown in FIG. 6, the first robotic pipe handler 96 transitions to the raised position 100 via rotation in a second direction 146 about the first handler axis 98. Moreover, as described above, the clamp jaw 112 rotates about the jaw axis 114 in a transfer direction 148 toward the transfer position 150 (FIG. 7). While in the transfer position 150, the back end 147 of the clamp jaw 112 faces away from the cage 66 (e.g., toward the horizontal pipe rack 144). In other words, the clamp jaw 112 rotates about the jaw axis 114 to change the orientation of the tubular 38 to enable the transfer of the tubular 38 from the first robotic pipe handler 96 to the second robotic pipe handler 116. While the illustrated embodiment shows the clamp jaw 112 rotating about the jaw axis 114 during the transition between the lowered position 102 and the raised position 100, in other embodiments the clamp jaw 112 may rotate about the jaw axis 114 before the first robotic pipe handler rotates in the second direction 146 about the first handler axis 98 or after the first robotic pipe handler reaches the raised position 100.

In FIG. 7, the second robotic pipe handler 116 engages the tubular 38 after the tubular 38 is positioned inside the cage 66 by the first robotic pipe handler 96. As mentioned above, the clamp jaw 112 of the first robotic pipe handler 96 is in the transfer position 150, thereby aligning the tubular 38 with the third clamp 128 in a hand off position 152. For example, the third clamp 128 may rotate about the second clamp axis 140 in a hand off direction 154 to position the third clamp 128 in the hand off position 152. While in the hand off position 152, the clamp jaws 112 of the second and third clamps 126, 128 face the first passage 88 (e.g., the clamp jaws 112 are oriented toward the stand direction 124). Accordingly, the clamp jaws 112 of the second robotic pipe handler 116 are configured to receive the tubular 38 from the first robotic pipe handler 96. In other words, the first robotic pipe handler 96 is "handing off" the tubular 38 to the second robotic pipe handler 116. As mentioned above, the second robotic pipe handler 116 is configured to move along the tracks 118 in the rig direction 122 and the stand direction 124 via the first actuators 120. In the illustrated embodiment, the first actuators 120 have positioned the second robotic pipe handler 116 within the cage 66. Moreover, the bracket 132 has lowered the body 130 in the downward direction 138 such that the third clamp 128 is aligned with the pipe rack 80 and/or the tubular 38.

As shown, the second robotic pipe handler 116 is at least partially positioned inside of the cage 66 via the first actuator 120 driving the body 130 to move in the stand direction 124. Moreover, the second actuator 142 drives the third clamp 128 laterally away from the body 130 (e.g., in the stand direction 124) and toward the tubular 38, enabling the clamp jaw 112 to engage the tubular 38. Accordingly, the clamp jaw 112 secures the tubular 38 to the third clamp 128 as the first robotic pipe handler 96 releases the tubular 38. As a result, the hand off is complete and the first pipe handler 96 may transition to the lowered position 102 to retrieve another tubular 38 while the second robotic pipe handler 116 places the tubular 38 in the pipe racks 80 or in the centered position over the wellbore 30.

Figure 8:
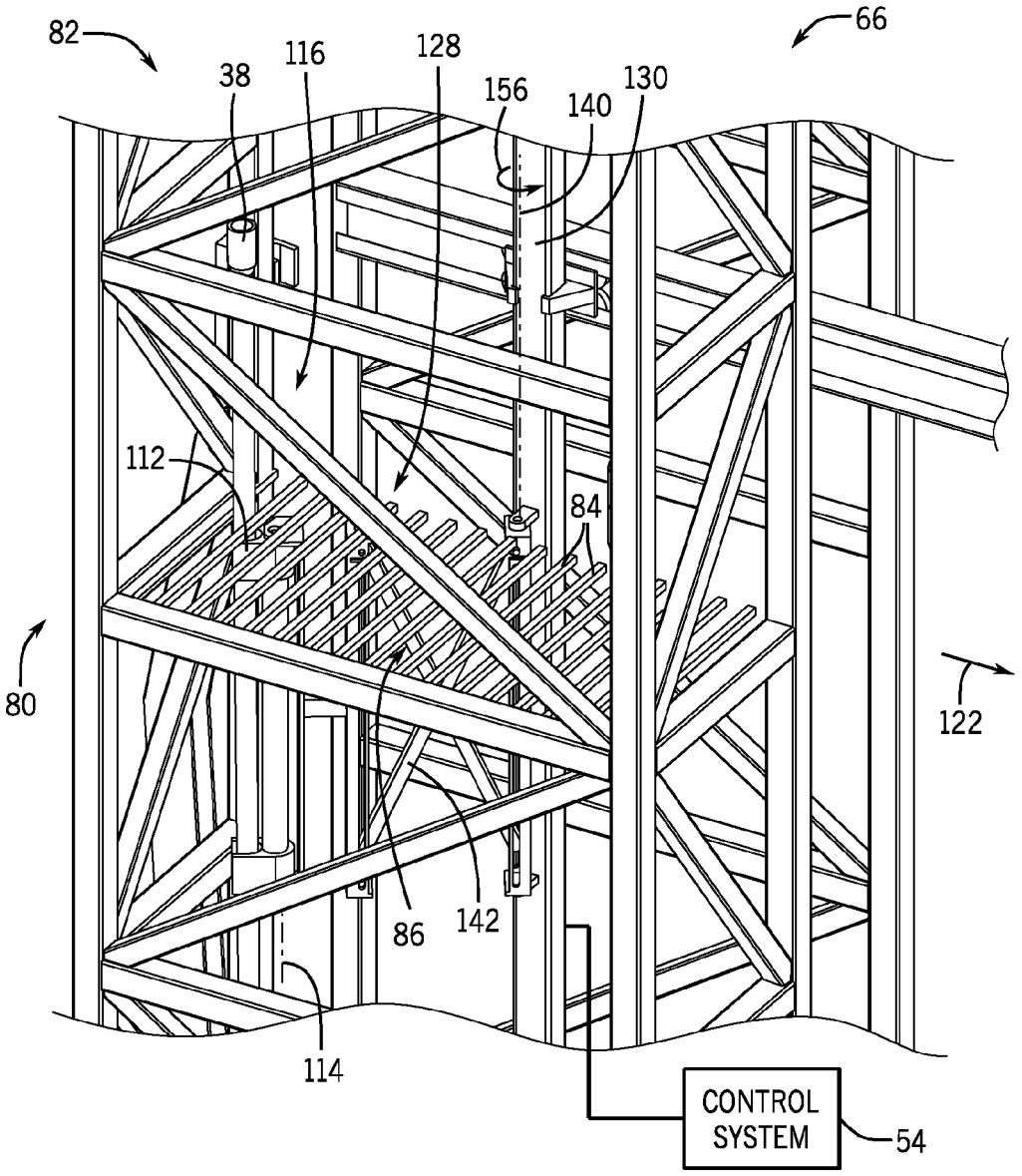
FIG. 8 is a perspective view of the second robotic pipe handler of FIG. 4, in which the second robotic pipe handler has placed the tubular in a pipe rack, in accordance with present techniques.

FIG. 8 illustrates the second robotic pipe handler 116 positioning the tubular 38 in the vertical orientation 82 in the pipe rack 80. As shown, the tubular 38 is secured to the third clamp 128 via the clamp jaw 112. Moreover, the second actuator 142 has displaced the third clamp 128 laterally away from the body 130. Furthermore, as mentioned above, the third clamp 128 rotates about the second clamp axis 140 in a wellbore direction 156 to position the tubular 38 in the rack space 86 of the pipe rack 80. Additionally, in certain embodiments, the clamp jaw 112 may rotate about the jaw axis 114 to further align the tubular 38 within the rack space 86 of the pipe rack 80. In certain embodiments, the control system 54 is configured to monitor and record the position of the tubulars 38 in the pipe rack 80. As a result, the control system 54 may adjust the position of the second robotic pipe handler 116 to place the tubulars 38 in the pipe racks 80. For example, the control system 54 may determine that a section of the pipe rack 80 is full and move the second robotic pipe handler 116 in the rig direction 122 to enable the second robotic pipe handler 116 to place the tubular 38 in an open section of the pipe rack 80.

Figure 9:
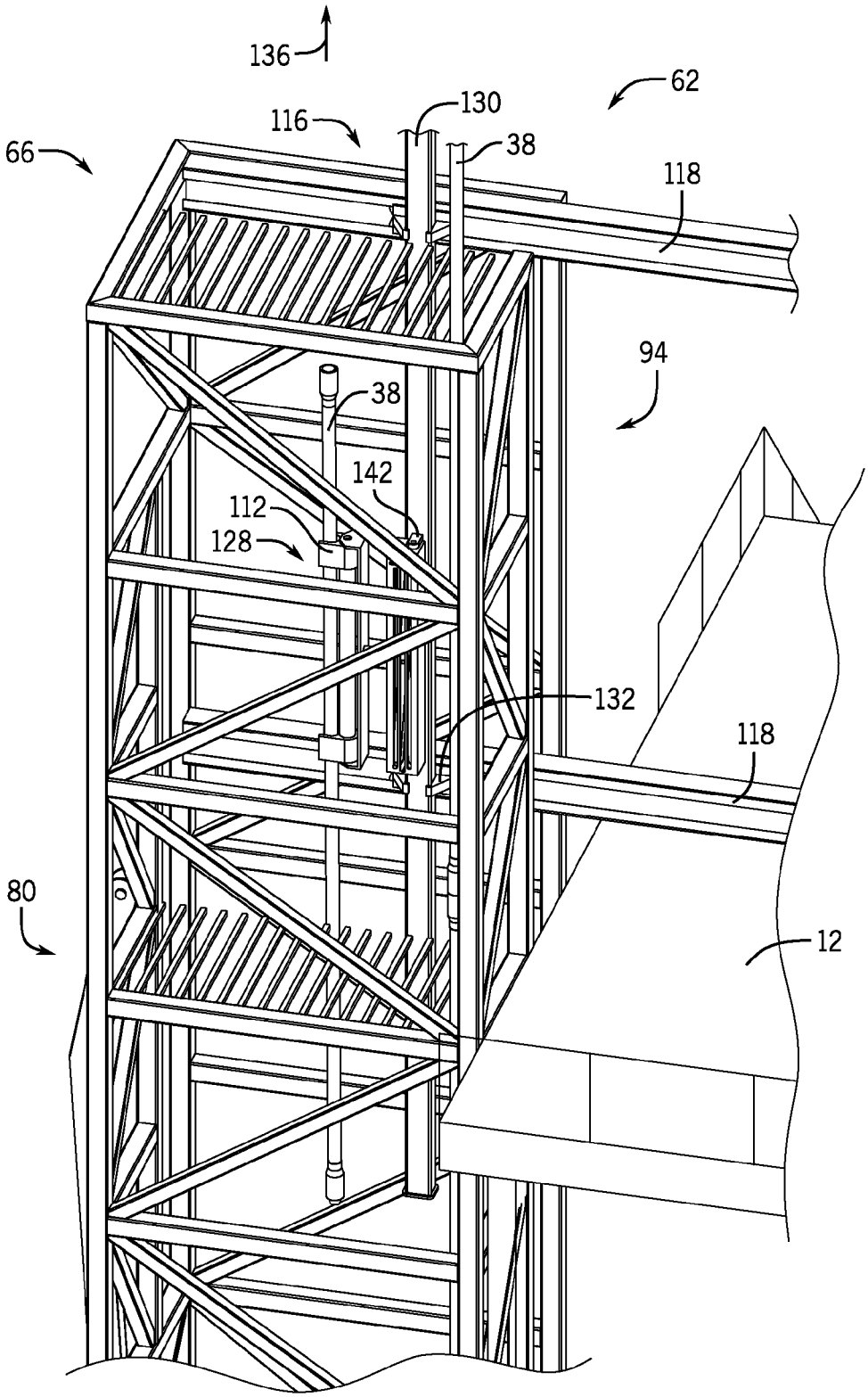
FIG. 9 is a perspective view of the second robotic pipe handler of FIG. 4, in which the second robotic piper handler transitioning the tubular in an upward direction, in accordance with present techniques.

In FIG. 9, the tubular 38 is secured to the third clamp 128 via the clamp jaw 112. In certain embodiments, the second robotic pipe handler 116 is configured to remove the tubular 38 from the pipe rack 80. Moreover, the bracket 132 drives the body 130 in the upward direction 136. In the illustrated embodiment, the pipe handling system 62 is positioned proximate to and partially below the rig floor 12. (e.g., the pipe rack 80 is approximately level with the rig floor 12). As a result, the tubular 38 is moved in the upward direction 136 to align the tubular with the wellbore 30 and/or the top drive 42. Moreover, the second actuator 142 is retracted, thus moving the third clamp 128 laterally toward the body 130. It will be appreciated that retracting the second actuator 142 reduces the force applied on the third clamp 128 by the tubular 38. However, in other embodiments, the second actuator 142 may remain extended while the body 130 is moved in the upward direction 136. Furthermore, as shown, the third clamp 128 is aligned with the second passage 94, thereby reducing the likelihood of contact between the second robotic pipe handler 116 and the pipe racks 80.

Figure 10:
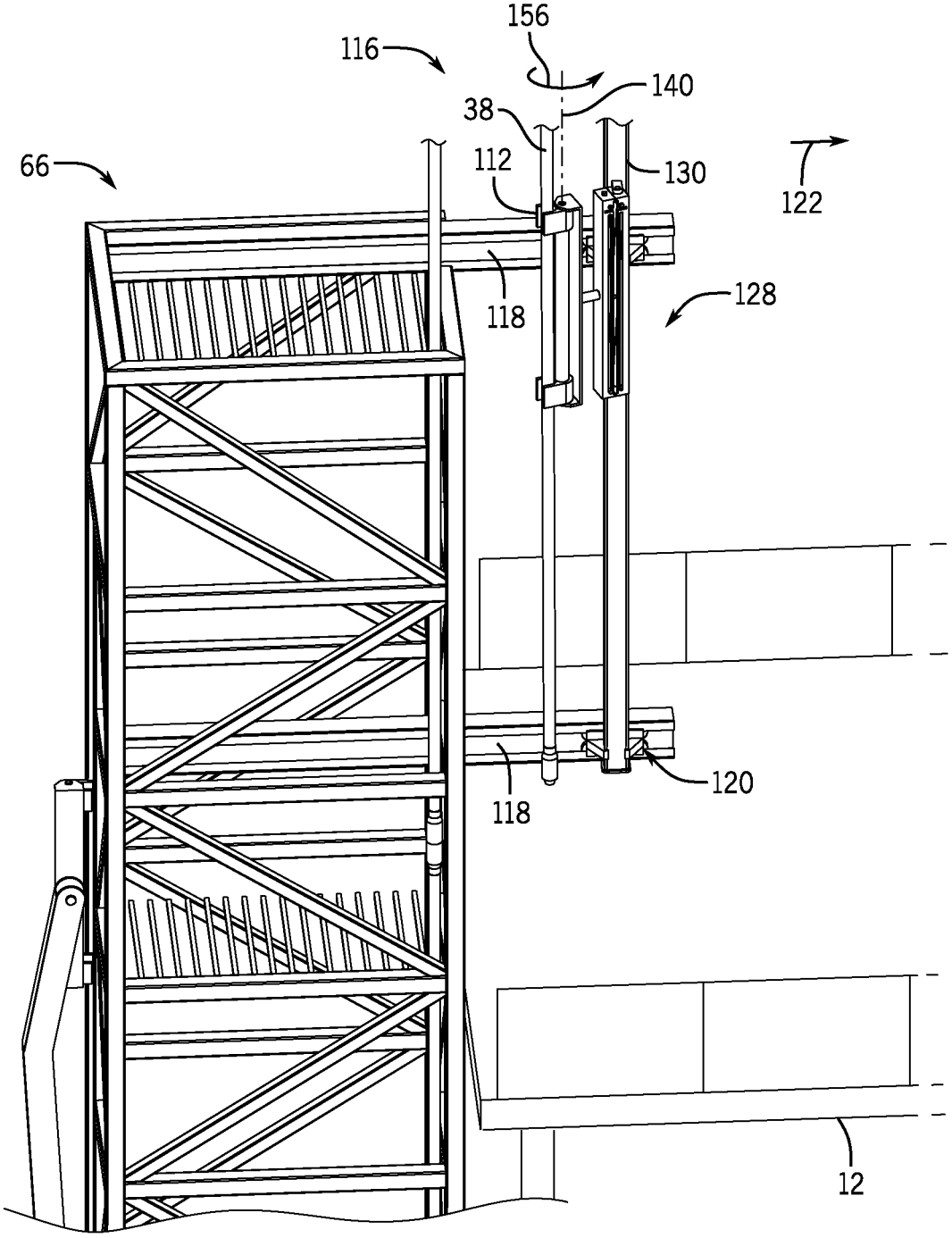
FIG. 10 is a perspective view of the second robotic pipe handler of FIG. 4, in which the tubular is positioned above a rig floor, in accordance with present techniques.

FIG. 10 illustrates the second robotic pipe handler 116 driven in the rig direction 122 to a far end of the tracks 118. As shown, the tubular 38 is no longer within the cage 88 due to the body 130 being driven in the rig direction 122 along the tracks 118 by the first actuator 120. As a result, the tubular 38 is suspended over the rig floor 12 before being positioned over the wellbore 30. Furthermore, the third clamp 128 rotates about the second clamp axis 140 in a wellbore direction 156 toward a placement position. As will be described below, rotating the third clamp 128 about the second clamp axis 140 in the wellbore direction 156 enables the second robotic pipe handler 116 to position the tubular 32 over the wellbore 30 in the centered position.

Figure 11:
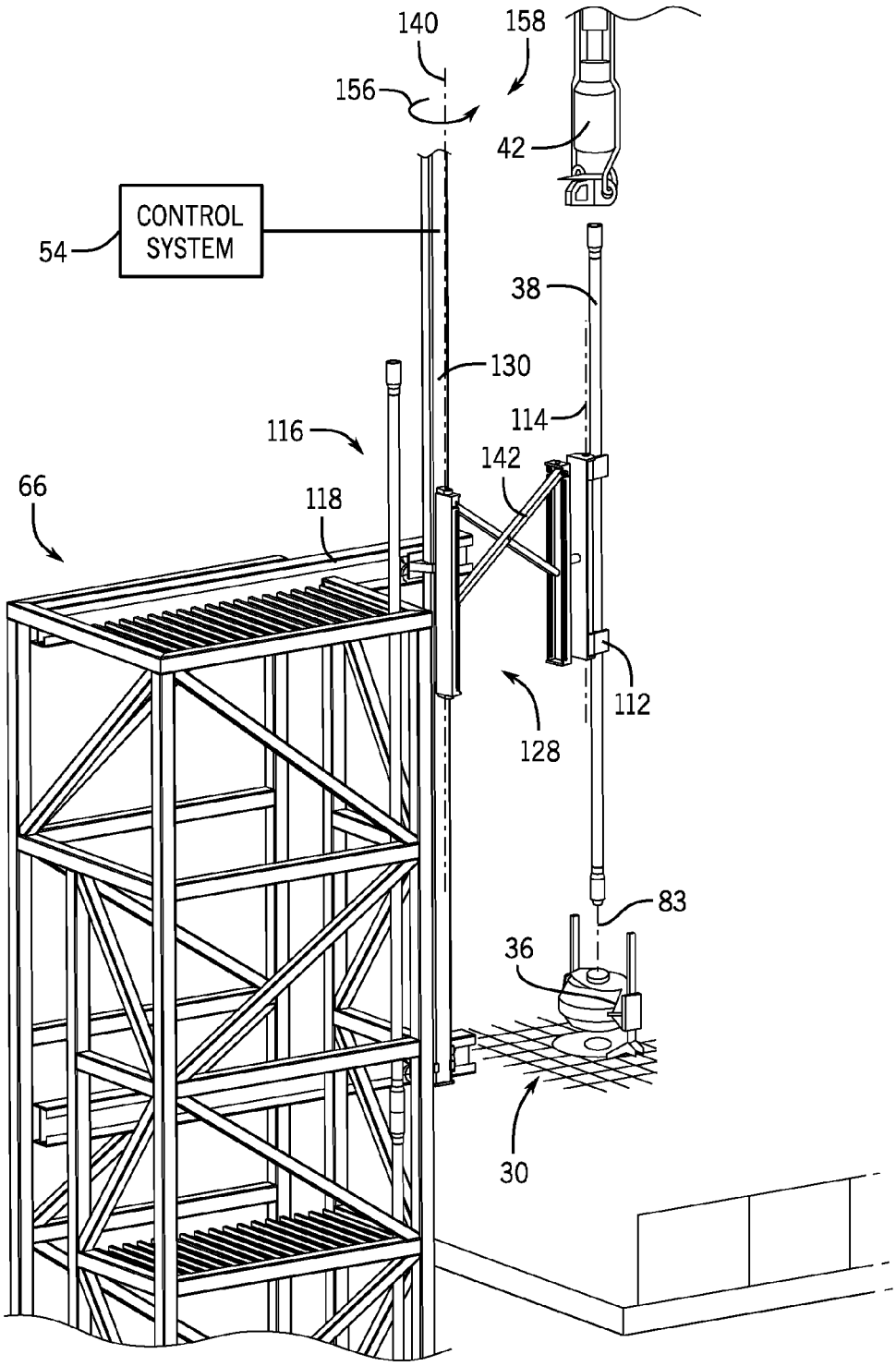
FIG. 11 is a perspective view of the second robotic pipe handler of FIG. 4, in which the tubular is being centered over a wellbore, in accordance with present techniques.

In FIG. 11, the second robotic pipe handler 116 is positioning the tubular 38 over the wellbore 30 in a centered position 158 via the extension of the second actuator 142. While in the centered position, the tubular 38 is substantially centered over the wellbore 30, such that the tubular 38 may engage with the stump 36 and/or the top drive 42. As mentioned above, substantially centered may refer to the tubular 38 being approximately aligned with the wellbore 30. For instance, the longitudinal axis 83 of the tubular 38 may be offset from the axis of the wellbore 30 by two pipe diameters and be considered substantially centered over the wellbore 30. In certain embodiments, the control system 54 may be configured to place the tubular 38 over the wellbore 30 and/or into engagement with the top drive 42. When the tubular 38 is positioned over the wellbore 30, the top drive 42 may engage the tubular 38 and secure the tubular 38 to the stump 36 to continue drilling operations. In some embodiments, the top drive 42 may be an integral aspect of the second robotic pipe handler 116. In the illustrated embodiment, the tubular 38 is secured to the third clamp 128 as the clamp jaw 112 of the third clamp 128 is driven toward the wellbore 30 by the second actuator 142. As mentioned above, rotation of the third clamp 128 in the wellbore direction 156 about the second clamp axis 140 enables the tubular 38 to align with the wellbore 30. In the illustrated embodiment, the second actuator 142 laterally displaces the clamp jaw 112 of the third clamp 128 away from the body 130 (e.g., toward the wellbore 30). Moreover, in certain embodiments, the clamp jaw 112 is configured to rotate about the jaw axis 114 to enable alignment with the wellbore 30. As a result, drilling operations may continue by engaging the tubular 38 with the top drive 42 and adding the tubular 38 to the drill string 28.

In certain embodiments, the pipe handling system 62 is configured to learn the location of the centered position 158 relative to the cage 66. For instance, an operator may instruct the second robotic pipe handler to position the tubular 38 over the wellbore 30 in the centered position 158, via the controller 56. Thereafter, the operator may provide an indication to the controller 56 indicative of the centered position 158 (e.g., lateral position relative to the cage 66, vertical position relative to the cage 66). As a result, the controller 56 may store the location indicative of the centered position 158 (e.g., in the memory 60) for later use. For example, the second robotic pipe handler 116 may remove the tubular 38 from the pipe rack 80 and receive a signal directing the second robotic pipe handler 116 to transition the tubular 38 to the centered position 158. The controller 56 may access the stored location in the memory 60, thereby directing the second robotic pipe handler 116 back to the centered position 158. Moreover, in certain embodiments, other positions may be stored in the memory 60 for use by the controller 56. For example, the controller 56 may store the location of the tubulars 38 within the pipe rack 80 to facilitate faster transitions between positioning the tubulars 38 in the centered position 158 and obtaining a new tubular 38 from the pipe racks 80.

Figure 12:
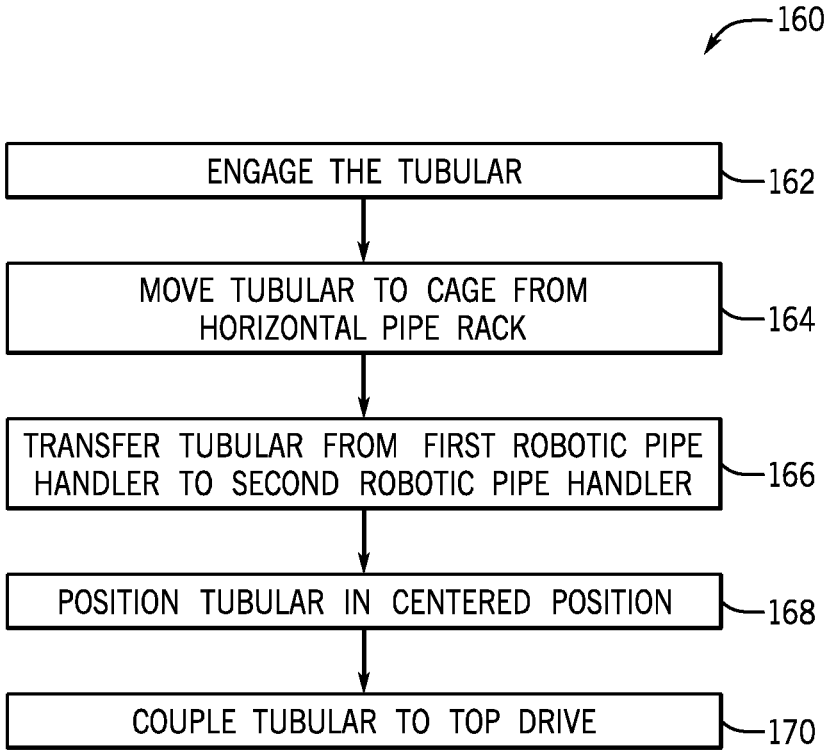
FIG. 12 is a flowchart of a method of transitioning a tubular from a horizontal pipe rack to a centered position over a wellbore, in accordance with present techniques.

FIG. 12 is a flow chart of an embodiment of a method 160 for positioning the tubular 38 in the centered position 158 over the wellbore 30, while the tubular 38 is in the vertical orientation 82, from the horizontal orientation 81 on the horizontal pipe rack 144. The first robotic pipe handler 96 engages the tubular 38 at block 162. For example, the first robotic pipe handler 96 may rotate about the first handler axis 98 in the first direction 106 to transition between the raised position 100 and the lowered position 102. Moreover, the first clamp 108 may rotate about a clamp axis 110 to align the clamp jaw 112 with the tubular 38. Thereafter, the clamp jaw 112 may engage the tubular 38 and secure the tubular 38 to the first clamp 108. The first robotic pipe handler 96 moves the tubular 38 from the horizontal pipe rack 144 to the cage 66 at block 164. In certain embodiments, the first robotic pipe handler 96 rotates about the first handler axis 98 in the second direction 146 to transition to the raised position 100 from the lowered position 102. Furthermore, the first clamp 108 may rotate about the jaw axis 114 in the transfer direction 148 to position the tubular 38 in the transfer position 150 to facilitate transfer to the second robotic pipe handler 116. The second robotic pipe handler 116 takes the tubular 38 from the first robotic pipe handler 96 at block 166. For example, the second robotic pipe handler 116 may move in the stand direction 124 along the tracks 118 to position the second and third clamps 126, 128 proximate to the tubular 38. In certain embodiments, the second actuator 142 extends the second and third clamps 126, 128 laterally away from the body 130 and toward the tubular 38 for engagement via the clamp jaws 112. Thereafter, the first robotic pipe handler 96 releases the tubular 38. The second robotic pipe handler 116 may position the tubular 38 in the centered position 158 over the wellbore 30 at block 168. For example, the second robotic pipe handler 116 may move in the upward direction 136 via the bracket 132 to position the tubular 38 above the rig floor 12. Moreover, the first actuators 120 may drive the body 130 in the rig direction 122 to bring the tubular 38 proximate to the wellbore 30. Furthermore, the second and third clamps 126, 128 may rotate about the second clamp axis 140 in the wellbore direction 156 to transition the tubular 38 toward the centered position 158. Thereafter, the second actuator 142 may drive the tubular 38 laterally away from the body 130 and position the tubular 38 over the wellbore 30 in the centered position 158. The top drive 42 may couple to the tubular 38 and couple the tubular 38 to the stump 36 at block 170. For instance, the top drive 42 may engage with a top portion of the tubular 38 and drive the tubular 38 in the downward direction 138 toward the stump 36. At the stump 36, the top drive 42 may facilitate connection to the stump 36 via rotation of the tubular 38. As a result, the tubular 38 is coupled to existing drill pipe and drilling operations may continue. As will be appreciated, removal and storage of the tubulars 38 may be accomplished by reversing the previously mentioned steps.

As described in detail above, embodiments are directed to the pipe handling system 62 configured to transition the tubular 38 from the horizontal orientation 81 to the vertical orientation 82 and the centered position 158 over the wellbore 30. For example, the first robotic pipe handler 96 may engage the tubular 38 in the horizontal orientation 81 and rotate about the first handler axis 98 to transition the tubular to the vertical orientation 81. Furthermore, in certain embodiments, the second robotic pipe handler 116 may receive the tubular 38 from the first robotic pipe handler 96. The second robotic pipe handler 116 is configured to drive the tubular 38 along the tracks 118 in the rig direction 122 and toward the wellbore 30. Moreover, the second actuators 142 of the second robotic pipe handler 116 may drive the tubular 38 toward the wellbore 30 and into the centered position 158. Accordingly, the top drive 42 and/or the stump 36 may engage the tubular 38 to continue drilling operations.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A system comprising:

a cage having a pipe rack configured to store a tubular in a vertical orientation, such that a longitudinal axis of the tubular is substantially perpendicular to a horizontal plane; and the cage having first and second robotic pipe handlers, with the first robotic pipe handler configured to transition the tubular from a horizontal orientation, in which the longitudinal axis of the tubular is substantially parallel to the horizontal plane, to the vertical orientation, wherein the first robotic pipe handler is adapted to move the tubular between the horizontal and vertical orientations by rotating about a first handler axis;

wherein the first robotic pipe handler is configured to position the tubular within the cage such that the tubular is receivable by the second robotic pipe handler after the first robotic pipe handler transitions the tubular from the horizontal orientation to the vertical orientation, and wherein the second robotic pipe handler receives the tubular into the cage through a first passage of the cage with the tubular in the vertical orientation.

2. The system of claim 1, wherein the first robotic pipe handler comprises a first clamp configured to rotate about a first clamp axis between an engagement position, in which the first clamp engages the tubular while the tubular is in the horizontal orientation and the first robotic pipe handler is in a lowered position, and a transfer position in which the tubular is in the vertical orientation and the first robotic pipe handler is in a raised position.

3. The system of claim 1, wherein the first robotic pipe handler is coupled to the cage and the cage is configured to be positioned proximate to a drilling rig without coupling to the drilling rig.

4. The system of claim 1, wherein the second robotic pipe handler is coupled to tracks of the cage, wherein the second robotic pipe handler is configured to move along a body axis in an upward direction and a downward direction, opposite the upward direction via a bracket and to move along the tracks in a rig direction and a stand direction, opposite the rig direction, via a first actuator.

5. The system of claim 4, wherein the second robotic pipe handler is configured to move in the stand direction to receive the tubular from the first robotic pipe handler and to position the tubular in the pipe rack.

6. The system of claim 5, wherein the second robotic pipe handler is configured to remove the tubular from the pipe rack and to transition the tubular in the wellbore direction and to position the tubular in a substantially centered position over a wellbore.

7. The system of claim 4, wherein the second robotic pipe handler comprises a second clamp and a third clamp positioned along a body of the second robotic pipe handler, wherein the second and third clamps are configured to rotate about a second clamp axis between a hand off direction and a well bore direction, which is opposite the hand off direction.

8. The system of claim 7, comprising a second actuator configured to laterally displace the second and third clamps from the body of the second robotic pipe handler.

9. The system of claim 1, comprising a controller configured to send a first signal to the first robotic pipe handler and a second signal to the first robotic pipe handler, wherein the first robotic pipe handler is configured to transition, via hydraulics, the tubular from the horizontal orientation to the vertical orientation in response to the first signal, and wherein the first robotic pipe handler is configured to transition, via hydraulics, between a raised position and a lowered position about the first handler axis in response to the second signal.

10. The system of claim 1, wherein the first robotic handler comprises an arm extending from the pivot to a first clamp, and wherein the arm is static between the pivot and the first clamp while the first robotic handler transitions the tubular between the horizontal and vertical orientations.

11. The system of claim 10, wherein the first clamp is rotatable with respect to the arm about a clamp axis, and wherein the clamp axis is substantially perpendicular to the arm.

12. The system of claim 11, wherein the first clamp comprises a jaw, and wherein the jaw is rotatable about a jaw axis substantially parallel to the first clamp.

13. A system comprising:

a controller configured to coordinate operation of a pipe handling system and a top drive system of a drilling rig to position a tubular in a centered position proximate to the top drive system and to enable the top drive system to engage the tubular;

a first robotic pipe handler of the pipe handling system communicatively coupled to the controller and configured to transfer the tubular from a horizontal orientation to a vertical orientation by rotating about a pivot, wherein the first robotic pipe handler is rotatably attached at the pivot to a cage that comprises a vertical pipe rack configured to store the tubular in the vertical orientation; and a second robotic pipe handler of the pipe handling system communicatively coupled to the controller and configured to transfer the tubular from the first robotic pipe handler to the vertical pipe rack;

wherein the cage is positioned adjacent to the drilling rig.

14. The system of claim 13, wherein the controller is configured to instruct the second robotic pipe handler to extend laterally in a rig direction from a position at least partially within a vertical pipe rack to a centered position configured to align the tubular with the top drive system and with a wellbore.

15. The system of claim 13, where the controller is configured to instruct the second robotic pipe handler to remove the tubular from a vertical pipe rack and to position the tubular in a centered position relative to a wellbore and the top drive system.

16. The system of claim 15, wherein the controller is configured to instruct the first robotic pipe handler to transition the tubular into a cage comprising the vertical pipe rack from a horizontal pipe rack.

17. The system of claim 13, wherein the controller is configured to instruct the second robotic pipe handler to return the tubular to the vertical pipe rack after the tubular is disengaged from the top drive.

* * * * *